US005221187A

United States Patent [19]

Lorea et al.

[11] Patent Number: 5,221,187

[45] Date of Patent: Jun. 22, 1993

[54] AXIAL FAN, PARTICULARLY FOR MOTOR VEHICLES FOR AGRICULTURAL USE

[75] Inventors: Angelo Lorea, Orbassano; Alberto A. Boretti, Prato; Alfredo Cevolini, Modena, all of Italy

[73] Assignee: Fiatgeotech-Technologie Per La Terra S.p.A., San Matteo, Italy

[21] Appl. No.: 793,147

[22] Filed: Nov. 18, 1991

[30] Foreign Application Priority Data

Dec. 21, 1990 [IT] Italy ..... 68052 A/90

[51] Int. Cl.[5] ..... F04D 29/38

[52] U.S. Cl. ..... 416/189; 416/195; 416/DIG. 2; 416/DIG. 5

[58] Field of Search ..... 416/17., 169 A, 189, 416/192, 195, DIG. 2, DIG. 5

[56] References Cited

U.S. PATENT DOCUMENTS

| | | | |
|---|---|---|---|
| 3,147,811 | 9/1964 | Klonoski | 416/169 A |
| 3,551,070 | 12/1970 | Gluckman . | |
| 4,358,245 | 11/1982 | Gray | 416/189 |
| 4,384,824 | 5/1983 | Woods | 416/169 A |
| 4,505,641 | 3/1985 | Tsuchikawa et al. | 416/189 R |
| 4,569,631 | 2/1986 | Gray, III | 416/189 |
| 4,684,324 | 8/1987 | Perosino | 416/189 |
| 4,692,053 | 9/1987 | Sampedro | 416/169 A |
| 5,000,660 | 3/1991 | Van Houten et al. | 415/119 |

FOREIGN PATENT DOCUMENTS

| | | |
|---|---|---|
| 0373322 | 6/1990 | European Pat. Off. . |
| 8903903 | 7/1989 | Fed. Rep. of Germany . |
| 2459387 | 6/1980 | France . |

*Primary Examiner*—John T. Kwon

*Attorney, Agent, or Firm*—Sughrue, Mion, Zinn Macpeak & Seas

[57] ABSTRACT

In an axial fan, the angle of curvature of the median line of each blade in axial projection is nil at the hub and for about one third of the radial extension of the blade from the hub. The blade angle of each blade is substantially constant along the blade and the chord between the leading edge and the trailing edge of each blade is substantially constant along the blade between the hub and the outer ring.

10 Claims, 2 Drawing Sheets

AXIAL FAN, PARTICULARLY FOR MOTOR VEHICLES FOR AGRICULTURAL USE

BACKGROUND OF THE INVENTION

The present invention relates to an axial fan, particularly for use in motor vehicles for agricultural use, intended to provide particularly silent operation.

More specifically, the invention relates to an axial fan comprising a central hub, a plurality of blades which extend from the hub to the periphery and which are curved forwardly in the direction of rotation of the fan and an outer ring coaxial with the hub, to which the peripheral ends of the blades are connected.

An axial fan of the said type is described, for example, in the U.S. Pat. No. 4,358,245. The said fan according to the prior art is constructed in one single piece from moulded plastics material and has blades which have a very marked forwards curvature. In the axial projection of the said fan the median line through each blade always has a positive angle of curvature, increasing steadily from the hub to the outer ring.

In the said U.S. patent it is furthermore stipulated that the angular extension of the median line of each blade must be greater than half of the distance between two adjacent blades.

It follows that, in the case of the fan according to U.S. Pat. No. 4,358,245, the length of the blades is fairly considerable and this has repercussions on the amount of material needed to produce the blades and therefore the weight of the fan. Furthermore, the considerable length of the blades results in a lessening of the vibration frequencies of the said blades, and this may lead to a certain instability and a reduction in performance and in the silent running of the fan.

To overcome these drawbacks, it has been proposed to produce axial fans in which, proceeding from the hub towards the outer ring, each blade is firstly curved rearwardly in respect of the direction of rotation of the fan and therefore in its peripheral portion it is forwardly incurvate. Solutions of this type, which make it possible already to achieve a certain reduction in the length of the blades, are described, for example, in U.S. Pat. Nos. 4,569,631 and 4,684,324.

The fans disclosed by the said documents are intended to be produced in one single piece in moulded plastics material and are intended to be used in conjunction with the radiator of a motor vehicle.

SUMMARY OF THE INVENTION

An object of the invention is to produce an axial fan which is silent in operation and which has blades which are furthermore of reduced length, with consequent benefits in terms of weight and stability of operation, as well as in fairly high speeds of rotation.

The interest in achieving this object is felt all the more in the case of fans intended for motor vehicles for agricultural and earth-moving applications, such as tractors, excavators etc. In fact, for use on such motor vehicles, it is appropriate that the fans should be made from a metallic material rather than from a plastics material which means that generally they are intrinsically heavier than those which are intended for use on motor cars.

The fans according to U.S. Pat. Nos. 4,569,631 and 4,684,324 comprise blades of a fairly complex form which gives rise to no shortage of production problems. Thus, for example, U.S. Pat. No. 4,569,631 prescribes particular patterns of the angle of curvature of the leading and trailing edges of the blades; furthermore, the chord between the leading edge and the trailing edge of each blade must decrease from the hub to the outer ring.

According to U.S. Pat. No. 4,684,324, on the other hand, the blades have a progressively increasing chord from the hub to the outer ring.

A further object of the invention is therefore to provide an axial fan which operates silently and which comprises blades of simplified and more easily produced form.

With a view to achieving the aforesaid objects, the present invention relates to an axial fan of the above-specified type, characterised in that the angle of curvature of the median line through each blade in axial projection is substantially nil at the hub and for about one third of the radial extension of the blade from the hub;

the angle of incidence (blade angle) of each blade is substantially constant between the hub and the outer ring;

each blade is of constant thickness and the chord between the leading edge and the trailing edge of each blade is substantially constant between the hub and the outer ring.

Preferably, according to a further aspect of the invention, each blade is produced in such a way that it has a substantially constant angle of deflection (camber angle) between the hub and the outer ring.

BRIEF DESCRIPTION OF THE DRAWINGS

Further characteristic features and advantages of the invention will become apparent from the following detailed description which is given with reference to the attached drawings which are provided purely by way of non-limitative example and in which.

DETAILED DESCRIPTION OF THE INVENTION

Figure 1:
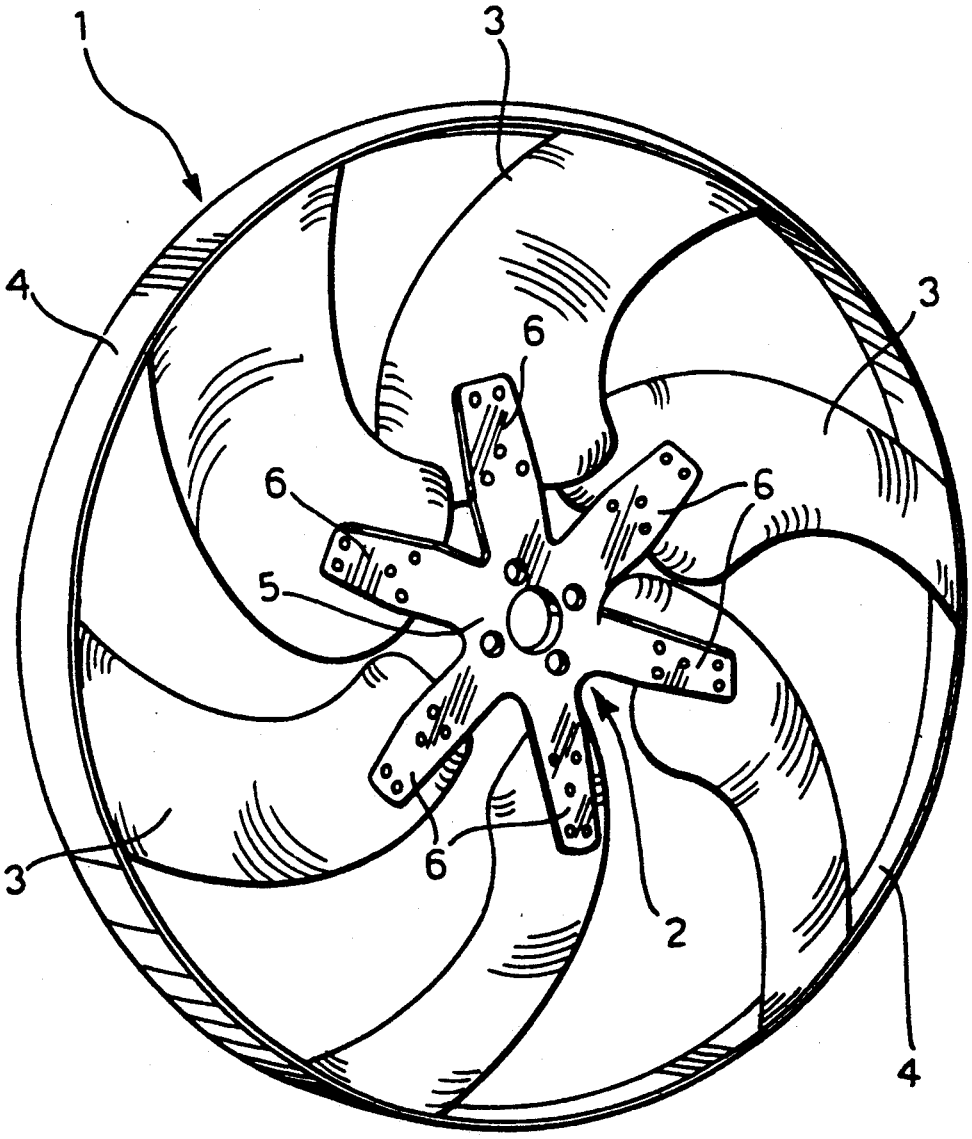
FIG. 1 is a perspective view of an axial fan according to the invention.

In drawings, reference numeral 1 generally designates a fan unit comprising a central hub 2, a plurality of blades 3 and an outer ring 4.

In the embodiment shown, the hub 2 is of a metallic material such as aluminium, its alloys or other alloys and it has a central annular portion 5 from which six arms 6 extend radially outwardly. The arms 6 are twisted so that they are not coplanar with the annular portion 5 of the hub but instead they are all rotated through the same angle (blade angle) which is between 20° and 30° and which is preferably about 25°.

In view of the use of the fan on a motor vehicle for agricultural use, the blades 3 are also ideally made from a metallic material, preferably aluminium or its alloys or other metallic alloys, and have the respective inner ends connected in an ordered way to the arms 6 of the hub 2, and the peripheral ends welded to the inner surface of the ring 4. For use in the agricultural field, too, the said ring is suitably constructed from a metallic material such as aluminium or its alloys.

Each blade 3 extends from its inner end, disposed at a radial distance $R_i$ from the axis of the hub 2, as far as its junction with the outer ring 4, situated at a radial distance $R_o$ from the axis of the hub.

Figure 2:
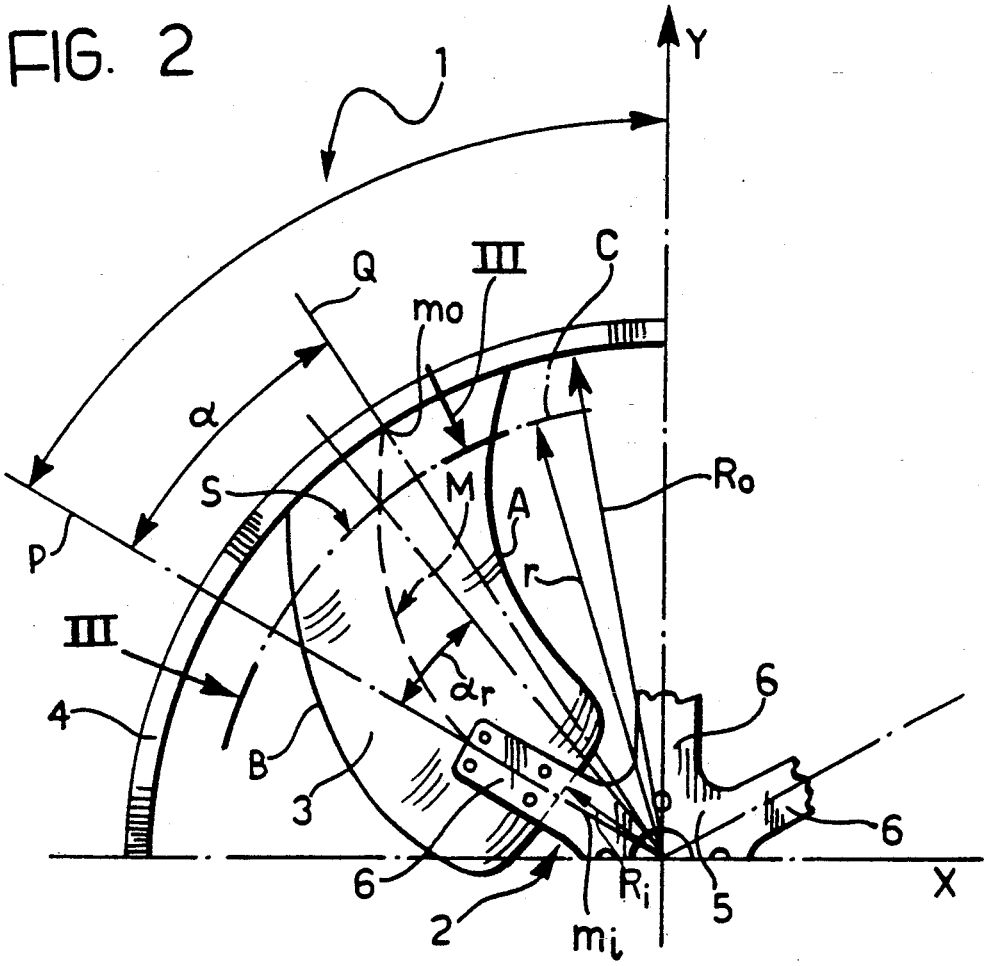
FIG. 2 is a partial frontal elevation of a fan according to FIG. 1.

With reference to the front view of FIG. 2, M indicates the median line (in axial projection) of a blade. C denotes a generic circumference with the centre on the axis of the fan, and with a radius r of between $R_i$ and $R_o$. S denotes the circular thickness of a blade 3 at the circumference C. The circular thickness S is therefore defined as the arc on the circumference C which is between the points at which the said circumference intersects the projections A and B of the leading and trailing edges of the blade respectively.

The median line M, which is shown as a broken line, starts at a point $m_i$ which represents the hub and ends at a point $m_o$ which corresponds to the ring 4.

In FIG. 2, P and Q indicate the radial directions which pass through the points $m_i$. and $m_o$. The angle $\alpha$ between the said directions represents the total or final angle of curvature (skew angle) of each individual blade. The said angle, as will be more clearly apparent hereinafter, is preferably equal to about +25°.

Still the reference to FIG. 2, $\alpha_r$ indicates the angle of curvature of the median line M of the blade at the generic circumference C.

In the fan according to invention, as FIG. 2 shows, the angle of curvature $\alpha_r$ of the median line M of each blade (in axial projection) is nil at the hub. In other words, the radial direction P is a tangent on the line M corresponding to the inner end of the blade; furthermore, beginning from the hub, the median line M is maintained for a certain distance which is substantially coincident with the radial direction P: in other words, the angle of curvature $\alpha_r$ of the median line M remains substantially nil over the initial portion of the blade, proceeding from the hub towards the outer ring. As will become apparent from the numerical example described hereinafter, the portion of the blade in which the median line shows a rectilinear pattern extends over about one third of the radial extension $R_o-R_i$ of each blade.

Figure 3:
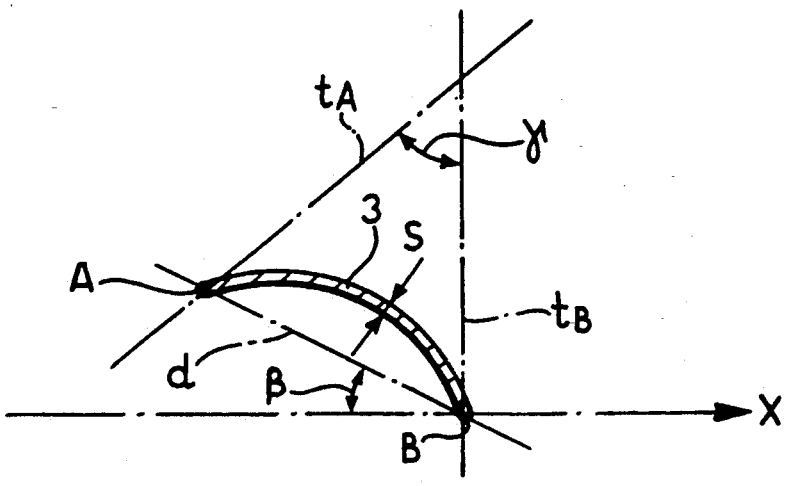
FIG. 3 is a partial sectional view taken on the line III—III in FIG. 2.

In FIG. 3, $\beta$ indicates the blade angle in the generic section corresponding to the circumference C in FIG. 2. The angle $\beta$ is between 20° and 30° and is preferably equal to approximately 25° and is furthermore constant from the hub 2 to the outer ring 4.

In FIG. 3, d denotes the chord between the leading edge A and the trailing edge B of the blade. The said chord, like the circular thickness S of the blade, is substantially constant along the entire blade from the hub 2 to the outer ring 4.

The effective thickness of each blade, indicated as S in FIG. 3, is also preferably constant and is between 1% and 3%, preferably approximately 2%, of the chord d.

In FIG. 3 $\gamma$ denotes the angle of deflection (camber angle) of the general blade. The said angle is defined between the straight lines $t_A$ and $t_B$ which are tangents on the section of blade corresponding to the leading edge A and trailing edge B respectively. The angle $\gamma$ is also constant along the blade and is between 45° and 55°, preferably 50°.

As is apparent from FIG. 2, the edges from the end of each blade which is inclined towards the hub 2 have a rounded profile.

EXAMPLE

An axial fan intended for use in conjunction with the radiator of a motor vehicle and produced according to the invention has the following characteristic features:
outer radius of the blades: 280 mm
inner radius: 80 mm
number of blades: 6
blade angle: 25°
ratio of s/d: 0.019
angle of deflection of the blades: 50°
angle of curvature $\alpha_r$ of the median line M: according to the following table

TABLE

| r (mm) | $\alpha_r$(°) |
|---|---|
| 80 | 0 |
| 102 | 0 |
| 124 | 0 |
| 147 | 0 |
| 169 | +0.8 |
| 191 | +5.9 |
| 213 | +11 |
| 236 | +16 |
| 258 | +21 |
| 280 | +25 |

Naturally, while the principle underlying the invention remains the same, the embodiments and details of production may be varied widely compared with what has been described and illustrated purely by way non-limitative example, without thereby departing from the scope of the present invention.

What is claimed is:

1. An axial fan for motor vehicles for agricultural use and for earth-moving machines, comprising:
a central hub,
a plurality of blades which extend form the hub to the periphery and which are forwardly curved in the direction of rotation of the fan, and
an outer ring coaxial with the hub and to which the peripheral ends of the blades are connected, wherein
the angle of curvature of the median line of the blade in axial projection is nil for about one third of the radial extension of the blade,
the blade angle of each blade is substantially constant along the blade between the hub and the outer ring,
each blade has a constant thickness,
the chord between the leading edge and the trailing edge of each blade is substantially constant along the blade between the hub and the outer ring,
the angle of deflection of each blade is substantially constant along the blade between the hub and the outer ring with the angle of deflection being between 45° and 55°.

2. A fan according to claim 1, wherein the hub, the blades and the outer ring are of metal.

3. A fan according to claim 2, wherein the peripheral ends of the blades are welded to the outer ring.

4. A fan according to claim 2, wherein the hub has a star-like configuration with a plurality of virtually radial arms to each of which is connected the inner end of a respective blade.

5. A fan according to claim 4, wherein the inner end of each blade is bolted or rivetted to an arm of the hub.

6. A fan according to claim 4, wherein the edges of the inner end of each blade have a rounded profile.

7. A fan according to claim 2, wherein it is of aluminum.

8. A fan according to claim 2, wherein it is of an aluminum alloy.

9. A fan according to claim 1, wherein the blade angle of the blades is between 20° and 30°.

10. A fan according to claim 1, wherein the thickness of each blade is between 1% and 3% of the chord between the leading edge and the trailing edge of the blade.

* * * * *